US007922831B2

(12) United States Patent
Pyo et al.

(10) Patent No.: US 7,922,831 B2
(45) Date of Patent: Apr. 12, 2011

(54) SUMP FOR DISHWASHER

(75) Inventors: Joon Ho Pyo, Seoul (KR); Sang Heon Yoon, Gwangmyung-si (KR); Tae Hee Lee, Boocheon-si (KR)

(73) Assignee: LG Electronics Inc., Seoul (KR)

( * ) Notice: Subject to any disclaimer, the term of this patent is extended or adjusted under 35 U.S.C. 154(b) by 1105 days.

(21) Appl. No.: 11/701,431

(22) Filed: Feb. 2, 2007

(65) Prior Publication Data

US 2008/0072936 A1 Mar. 27, 2008

(30) Foreign Application Priority Data

Sep. 27, 2006 (KR) ..... 10-2006-0093857

(51) Int. Cl.
*B08B 3/00* (2006.01)

(52) U.S. Cl. ..... 134/58 D; 134/56 D; 134/57 D

(58) Field of Classification Search ..... 134/56 D, 134/57 D, 58 D
See application file for complete search history.

(56) References Cited

U.S. PATENT DOCUMENTS 5,681,098 A * 10/1997 Ganzel et al. ..... 303/119.2
2006/0151016 A1* 7/2006 Jeon et al. ..... 134/111

* cited by examiner

*Primary Examiner* — Michael Barr
*Assistant Examiner* — Jason Heckert
(74) *Attorney, Agent, or Firm* — McKenna Long & Aldridge LLP

(57) ABSTRACT

A sump for a dishwasher includes a sump case for collecting washing fluid, a pump housing on the sump case, a filtering assembly provided on an upper portion of the pump housing, and a sealing member disposed around the pump housing. The pump housing is provided with a pump case therein.

4 Claims, 12 Drawing Sheets

SUMP FOR DISHWASHER

This application claims the benefit of Korean Patent Application No. 10-2006-0093857, filed on Sep. 27, 2006, which is hereby incorporated by reference as if fully set forth herein.

BACKGROUND OF THE INVENTION

1. Field of the Invention

The present invention relates to a dishwasher and, more particularly, to a sump for collecting and/or storing washing fluid and pumping out the collected washing fluid with high pressure.

2. Description of the Related Art

Generally, a dishwasher is a machine that washes and dries dishes by spraying washing fluid or water with high pressure to upper and lower racks. The dishwasher includes a tub, a dish rack on which the dishes are arranged, a spray nozzle for spraying washing water to surfaces of the dishes, and a sump mounted on a bottom of the tub and collecting the washing water.

In the conventional dishwasher, a foreign object collection filter is mounted in the sump to collect the food wastes generated during the washing process. Alternatively, the foreign object is ground into fine particles so that they can be drained together with the used water during the draining process.

The sump includes a sump case for collecting the washing water, a sump cover covering the sump case, a filter for filtering the foreign objects, and a washing pump. These parts are held together by coupling members such as screws.

The conventional sump has the following problems:

The process for assembling the parts of the sump is complicated. That is, the parts constituting the sump are manufactured through individual processes and are subsequently held together by coupling members. As a result, the number of the coupling members increases and thus the manufacturing cost increases. In addition, there may be leak between the parts that are assembled.

The flow resistance increases during the supply of the washing fluid from the washing pump to the water guide connected to the upper and lower nozzles.

Since the washing pump and the foreign object collection space are provided as a single part, foreign objects may be introduced into the washing pump through a boundary between the foreign object collection space and the washing pumps and thus the foreign objects may be sprayed together with the washing water through the nozzles.

Since a vario valve for dividing and directing the washing water pumped by the washing pump to the lower nozzle and the water guide is mounted in the sump case, the pumped washing water may leak around the vario valve during the washing water dividing process, and thereby lower the water pressure.

The washing water may leak from the washing pump during the washing water pumping process.

SUMMARY OF THE INVENTION

Accordingly, the present invention is directed to a sump for a dishwasher that substantially obviates one or more problems due to limitations and disadvantages of the related art.

An object of the present invention is to provide a sump for a dishwasher, which can prevent the leak of the washing water during the pumping process and simplify an assembling process of the sump.

Another object of the present invention is to provide a sump for a dishwasher, which can minimize the reduction in pumping pressure during the washing water pumping process by improving a passage of the washing water pumped by the washing pump.

Still another object of the present invention is to provide a sump for a dishwasher, which can prevent foreign objects collected in a foreign object collector from being introduced into the washing pump.

Still yet another object of the present invention is to provide a sump for a dishwasher, which can prevent washing water pumped by the washing pump from leaking around a vario valve.

Still yet further another object of the present invention is to provide a sump for a dishwasher, which can prevent the leak of the washing water during the washing water pumping process by improving a sealing structure of the washing pump.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a sump for a dishwasher, including: a sump case for collecting washing water; a pump housing seated on the sump case, the pump housing being provided with a pump case therein; a filtering assembly positioned on a upper portion of the pump housing to collect foreign objects; and a sealing member disposed around the pump housing.

According to another aspect of the present invention, there is provided a sump for a dishwasher, including: a pump housing including a pump case to pump out washing fluid, a guide passage connected to the pump case to direct the washing fluid to a lower nozzle or a fluid guide; a sealing member disposed around the stepped portion; and a flow guide covering the guide passage and the pump case, the flow guide includes a pressing rib to press a side surface of the sealing member.

According to embodiments of the present invention, the assembling process of the sump can be simplified.

In addition, because the passage of the washing water pumped by the washing pump is improved, the reduction in the pumping pressure during the washing water pumping process can be minimized.

Furthermore, because the introduction of the foreign objects collected in the foreign object collector into the washing pump can be prevented, the spraying of the foreign objects toward the dishes through the spraying nozzle can be prevented.

In addition, because the mounting location of the vario valve is improved, the leakage of the washing water from a portion around the vario valve can be prevented.

Furthermore, because a sealing member is provided around the side surface of the washing pump, the leakage of the washing water that is being pumped can be prevented.

It is to be understood that both the foregoing general description and the following detailed description of the present invention are exemplary and explanatory and should not be construed as limiting the scope of the claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED INVENTION

Reference will now be made in detail to the preferred embodiments of the present invention, examples of which are illustrated in the accompanying drawings. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

Figure 1:
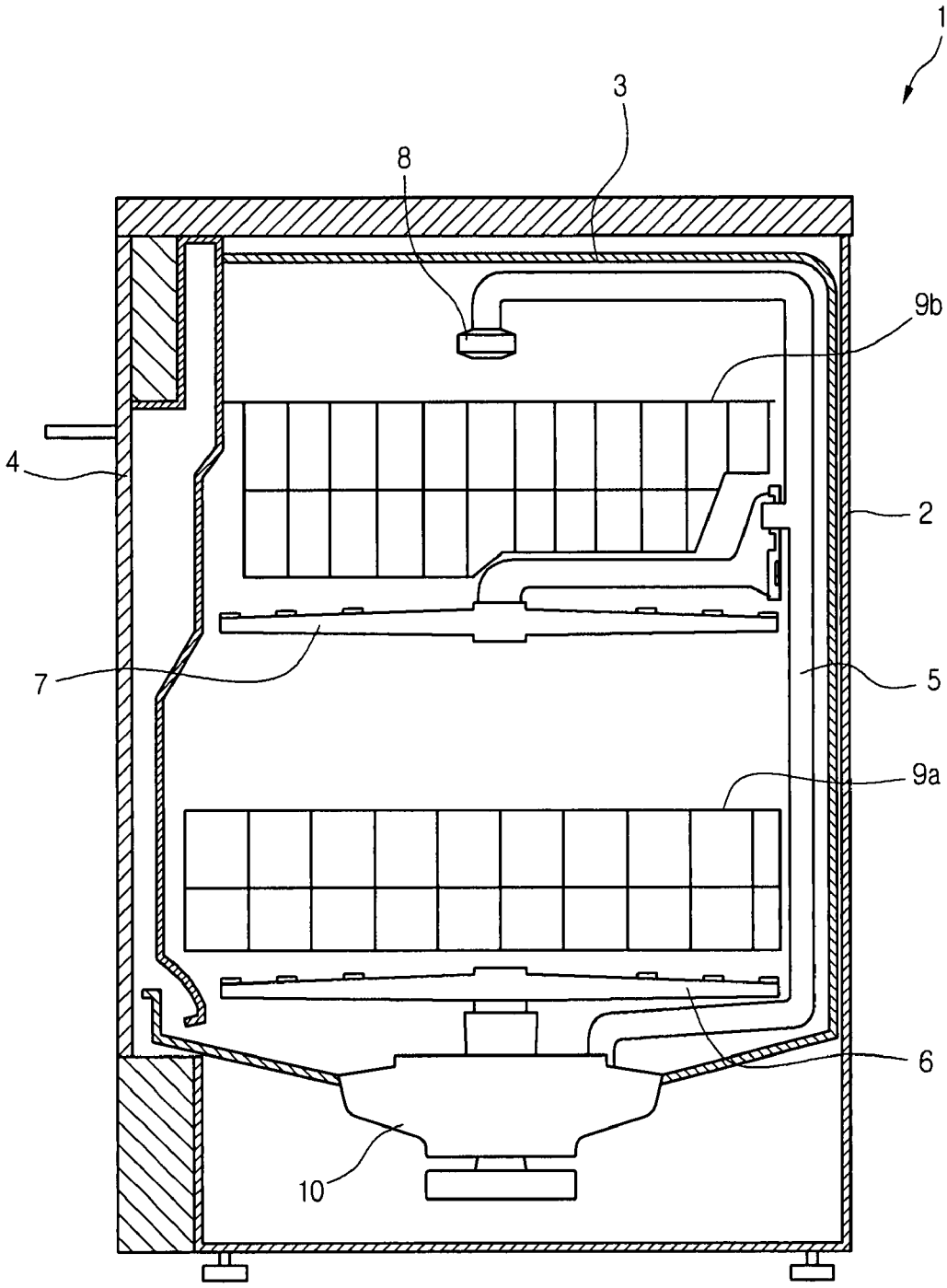
FIG. 1 is a side sectional view of a dishwasher with a sump according to an embodiment of the present invention.

FIG. 1 is a side sectional view of a dishwasher with a sump according to an embodiment of the present invention.

Referring to FIG. 1, a dishwasher 1 includes a cabinet 2 defining an outer appearance of the dishwasher 1, a door 4 pivotally coupled to a front surface of the cabinet 2, a tub 3 that is provided in the cabinet 2 to receive dishes, racks removably received in the tub 3, a sump 10 that is mounted on a bottom of the tub 3 to pump out the washing water, a lower nozzle 6 that is mounted on a top surface of the sump 10 to spray the washing water, a water guide 5 that is connected to the sump 10 to guide the washing water to an upper side of the tub 3, an upper nozzle 7 that is rotatable and extends from the water guide 5 to a central portion of the tub 3, and a top nozzle 8 that is connected to an upper end of the water guide 5 to spray the washing water.

The racks include an upper rack 9*b* disposed above the upper nozzle 7 and a lower rack 9*a* disposed above the lower nozzle 6.

Describing an operation of the dishwasher 1, the dishes are arranged on the racks 9*a* and 9*b* when the door 4 is opened and a washing mode is selected when the door 4 is closed. When the operation button is pushed, the washing water is supplied to the sump 10. When the washing water reaches a predetermined level, the washing pump mounted in the sump 10 is driven. The washing water pumped by the washing pump is alternately fed to the lower nozzle 6 and the water guide 5 by a vario valve (that will be described later). The washing water supplied to the water guide 5 is sprayed into the tub through the upper and top nozzles 7 and 8.

The washing water sprayed through the nozzles collides with surfaces of items in the dishwasher, such as dishes, to remove particles, food wastes, and other debris from the dishes. Particles, such as removed food wastes, fall to the bottom of the tub.

In addition, the washing process includes a pre-washing process for removing the foreign objects from the dishes, a main washing process in which washing water containing detergent is sprayed, a drying process for drying the dishes after the main washing process is finished. These processes are usually sequentially performed. The pre-washing and drying process are usually additional options that may be omitted by the user, if desired.

Figure 2:
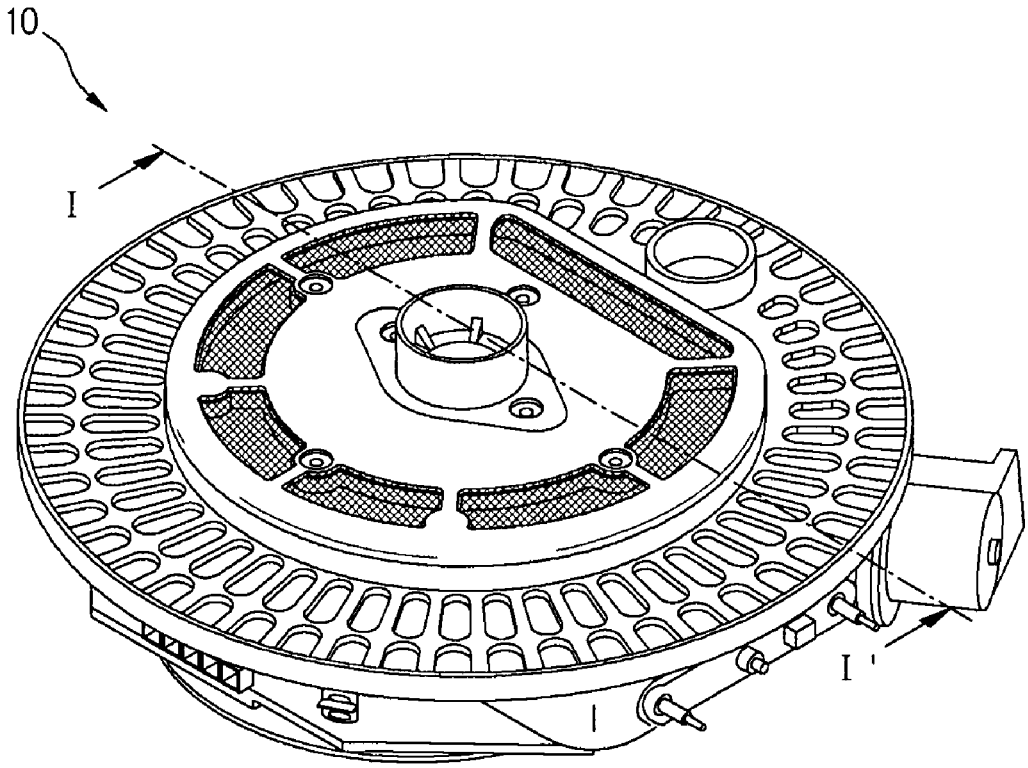
FIG. 2 is a perspective view of a sump for a dishwasher according to an embodiment of the present invention.
Figure 3:
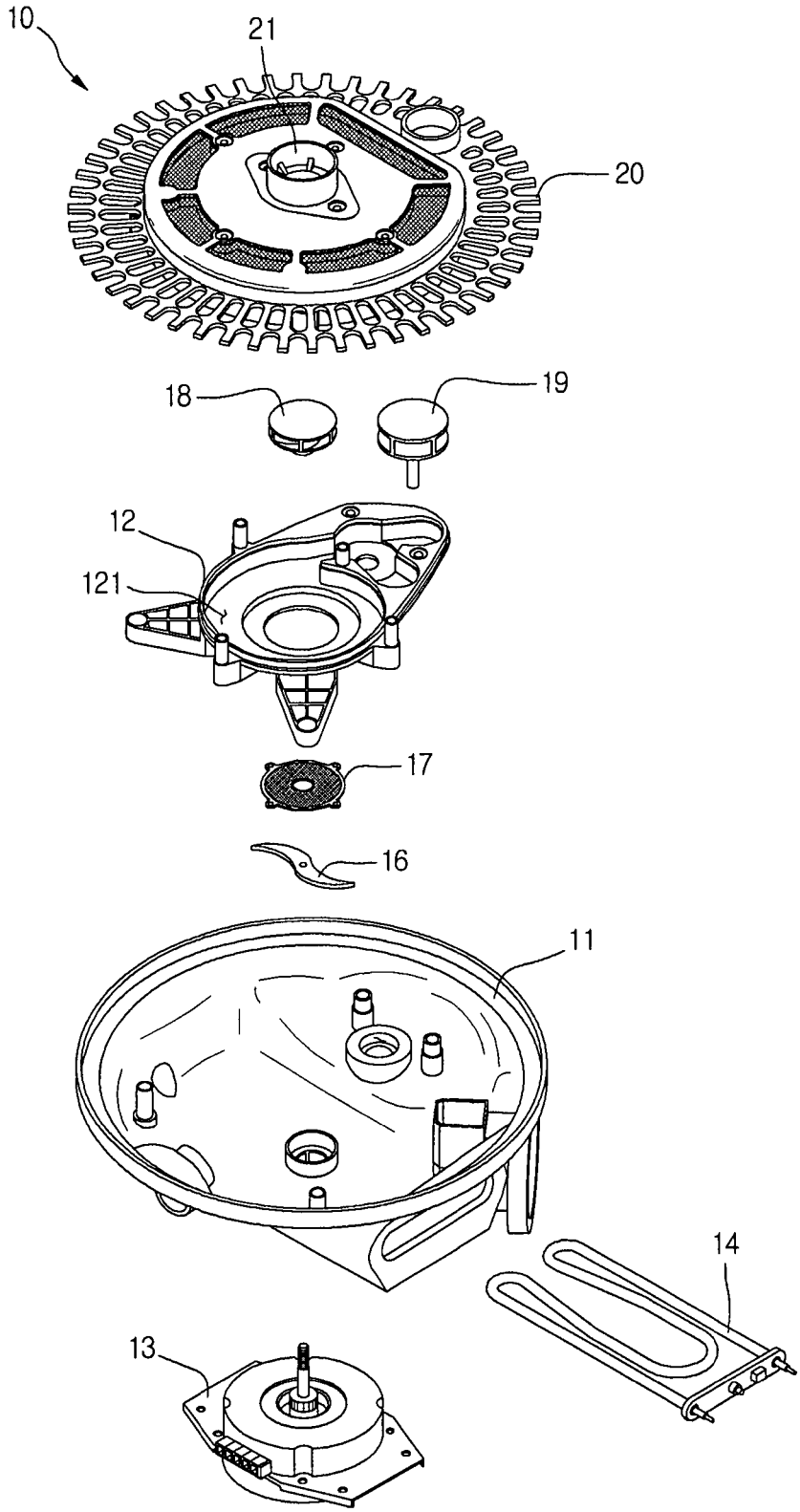
FIG. 3 is an exploded perspective view of the sump of FIG. 2.
Figure 4:
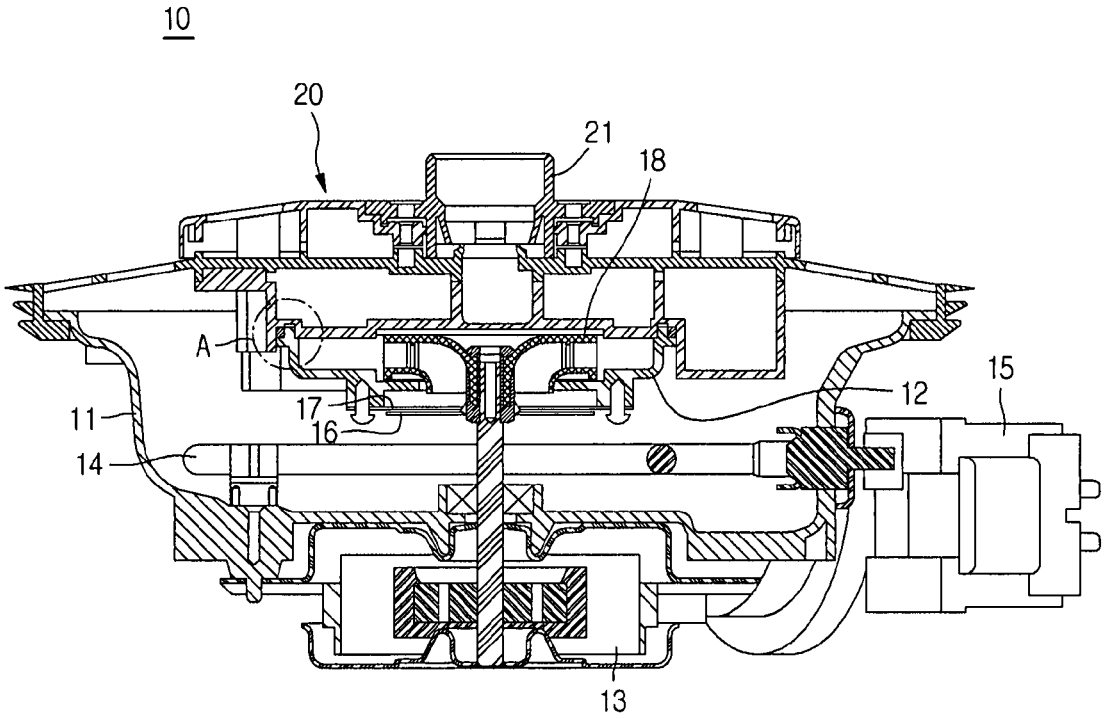
FIG. 4 is a sectional view taken along line I-I' of FIG. 2.

FIG. 2 is a perspective view of the sump. FIG. 3 is an exploded perspective view of the sump. FIG. 4 is a sectional view taken along line I-I' of FIG. 2.

Referring to FIGS. 2 through 4, the sump according to an embodiment includes a sump case 11 for collecting washing water, a washing pump assembly that is located inside the sump case 11 to pump out the washing water, a filtering assembly 20 coupled to an upper side of the washing pump assembly, a heater 14 that is provided inside the sump case 11 to heat the washing water, a washing motor 13 for driving the washing pump assembly, and a drain motor 15 for draining the washing water collected in the sump case 11.

The washing pump assembly includes a pump housing 12 provided with a pump case 121 and an impeller 18 that is provided in the pump case 121 to pump out the washing water. Here, the washing pump for pumping the washing water is an assembly of the pump case and the impeller.

A nozzle neck 21 on which the lower nozzle seats is coupled to the filtering assembly 20. The water guide 5 is coupled to an edge of the filtering assembly 20.

A screen filter 17 is coupled to a bottom of the pump housing 12 to filter out foreign objects from the washing water pumped by the washing pump. A disposer 16 is mounted under the screen filter 17 to grind any foreign objects contained in the washing water. The disposer 16 is connected to a motor shaft. Therefore, the impeller 18 and the disposer 16 rotate together with the motor shaft.

As described above, the sump 10 includes the sump case 11, the washing pump assembly, and the filter assembly 20. The filtering assembly 20 includes a self-cleaning filter, a sump cover, and a flow guide provided with a soil chamber, which are integrally coupled to each other through a thermal-bonding process. This will be described in more detail with reference to the accompanying drawings.

Figure 5:
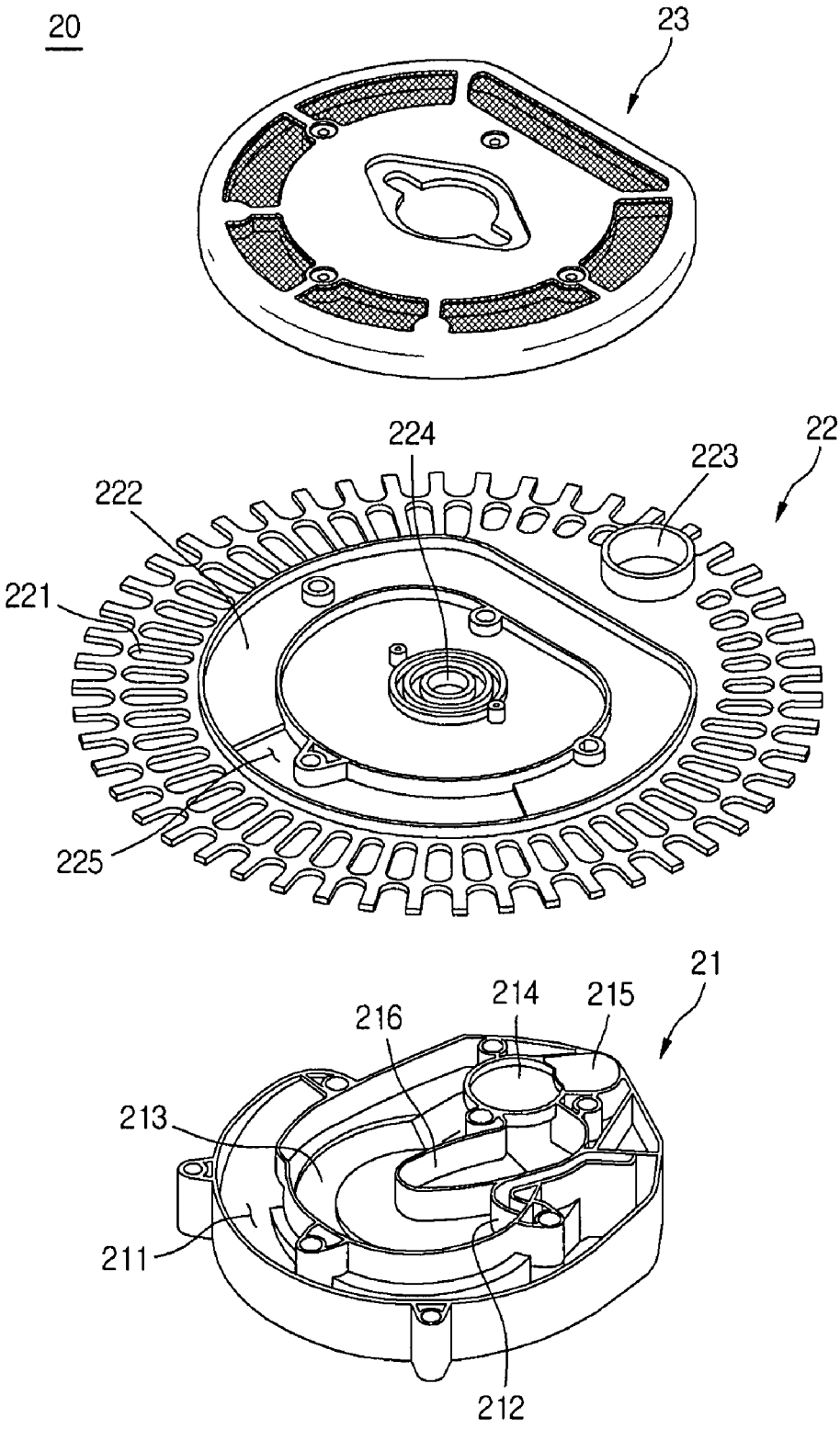
FIG. 5 is an exploded perspective view of a filtering assembly of a sump according to an embodiment of the present invention.

FIG. 5 is an exploded perspective view of the filtering assembly.

Referring to FIG. 5, the filtering assembly 20 includes the flow guide 21 for directing the washing water pumped by the washing pump to the lower nozzle and the water guide, the sump cover 22 is thermally-bonded to a top surface of the flow guide 21, and the self-cleaning filter 23 thermally-bonding to a top surface of the sump cover 22.

The soil chamber 211 having a predetermined size, dimension, or length is formed on an outer side of the flow guide 21 to collect particles, such as food wastes generated during the washing process. The soil chamber 211 is connected to the drain pump to drain the food wastes together with the washing water during the drain process. The soil chamber 211 is inclined downward toward the end connected to the drain pump so that the food wastes can be fully drained.

The pump case cover 213 is provided inside the soil chamber 211 and the pump case cover 213 seals an upper portion of the pump case (121 of FIG. 3). The vario valve 214 is formed at an end portion of the pump case cover 213. A water guide extension 215 and a lower nozzle extension 216 extend from the vario valve cover 214. The lower nozzle extension 216 is formed along a top surface of the pump case cover 213.

A sampling passage 212 is formed on an edge of the pump case cover 213 and is connected to the drain pump. That is, the sampling passage 212 is connected to the pump case 121 to divide the flow of the washing water. The washing water flowing along the sampling passage 212 is collected in the drain pump to flow back towards the soil chamber when the drain pump ceases to operate.

Meanwhile, the sump cover 22, thermal-bonded to the top surface of the flow guide 21, is provided with a plurality of water drain holes 221 arranged at predetermined intervals, thereby communicating with the sump case 11. That is, the washing water sprayed through the spraying nozzle is collected in the sump case 11 through the water drain hole 221.

A separation membrane 222 is formed on an interior portion of the sump cover with respect to the drain hole 221. The separation membrane 222 is opened to form a backflow hole 225. A lower nozzle connecting portion 224 is formed at a center of the sump cover 22 and the lower nozzle connecting portion 224 is connected to the lower nozzle extension 216 of the flow guide. Therefore, the washing water flowing towards the lower nozzle extension 216 is directed to the lower nozzle through the nozzle connecting portion 224.

In addition, a water guide connecting portion 223 is formed on an edge of the sump cover 22. The water guide connecting portion 223 communicates with the water guide extension 215 of the flow guide 21. Therefore, the washing water flowing along the water guide extension 215 is directed to the water guide.

The self-cleaning filter 23 integrally thermal-bonds with the top surface of the sump cover 22.

A net is disposed in the self-cleaning filter 23 to filter off the foreign objects contained in the washing water. The structure of the self-cleaning filter 23 will be described in more detail with reference to the accompanying drawings.

The washing water pumped by the washing pump is alternately supplied to the water guide extension 215 and the lower nozzle extension 216 according to a valve state or position of the vario valve. A portion of the washing water pumped by the washing pump is branched along the sampling passage 212 and falls toward the drain pump. When the drain pump ceases to operate, the washing water flows back to the soil chamber 211.

When the washing water is fully filled or overflowing in the soil chamber 211, the washing water flows back through the backflow hole 225 of the sump cover 22. A part of the washing water that flows back is distributed on a top surface of the separation membrane 222. Then, the foreign objects contained in the washing water are filtered while the washing water passes through the net disposed in the self-cleaning filter 23. Then, the purified washing water is collected in the sump case through the water drain hole 221. Here, the separation membrane 222 is slightly sloped downward toward the backflow hole 225 so that the filtered foreign objects can be collected in the soil chamber 211.

As the above-described process is repeatedly performed during the washing process, the foreign objects are collected in the soil chamber 211 and expelled to an external side during the water drain process.

Figure 6:
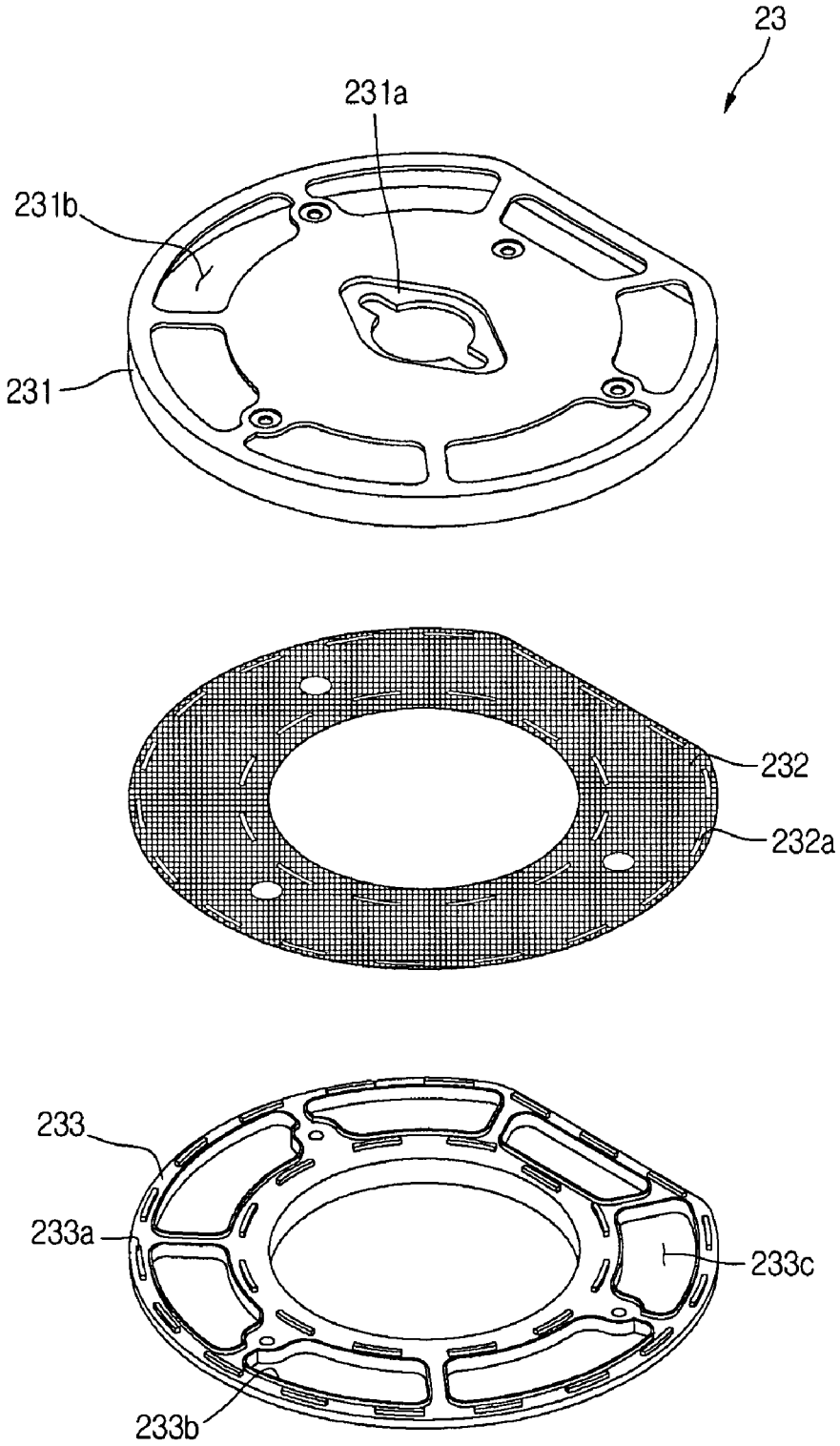
FIG. 6 is an exploded perspective view of a self-cleaning filtering assembly according to an embodiment of the present invention.

FIG. 6 is an exploded perspective view of the self-cleaning filtering assembly according to an embodiment of the present invention.

Referring to FIG. 6, the self-cleaning filter 23 includes a mesh 232 provided with a plurality of fine apertures, a lower cover 233 provided under the mesh 232, and an upper cover 231 provided above the mesh 232.

The lower cover 233 thermal-bonds to the upper cover 231 and the mesh 232 is fixed between the upper cover 231 and the lower cover 233.

A plurality of through holes 231*b* are formed in the upper cover 231. A nozzle neck seating portion 231*a* is formed on a central portion of the upper cover 231. A through hole is formed inside the nozzle seating portion 231*a* to direct the washing water to the lower nozzle.

In addition, a through hole 233*c* that is identical or similar in a shape to the through hole 231*b* is formed in the lower cover 233. The lower cover 233 is provided with a plurality of mesh fixing ribs 233*a* and a thermal bonding portion 233*b* that are formed on inner and outer circumferential edges. The mesh 232 is further provided at the inner and outer circumferential edges with holes 232*a* through which the mesh fixing ribs 233*a* penetrate.

The mesh fixing ribs 233*a* formed on a top surface of the lower cover 233 penetrates the mesh 232 and closely contacts the bottom surface of the upper cover 231. In this state, the upper cover 231 and the lower cover 233 closely contact each other and the thermal bonding process is performed by applying heat. During this thermal bonding process, the mesh 232 is tensely spread.

Figure 7:
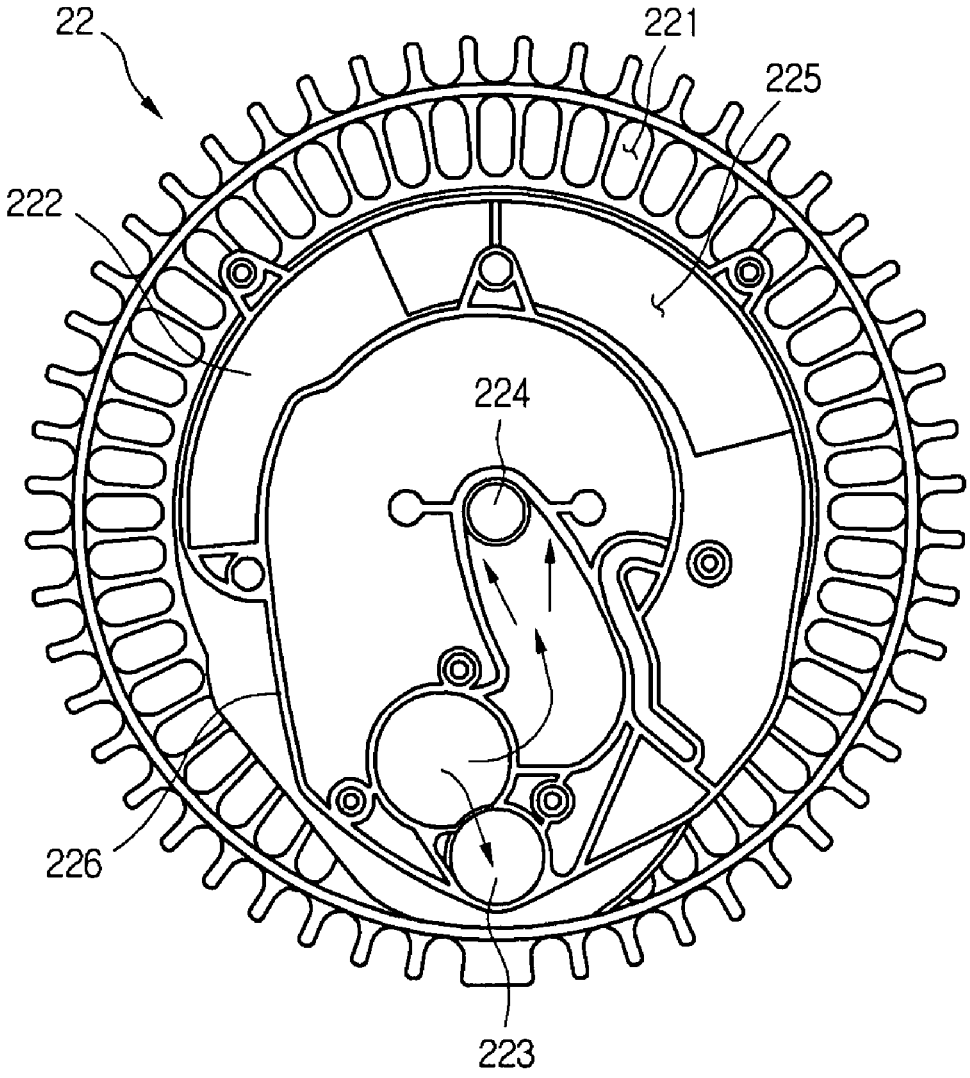
FIG. 7 is a bottom view of a sump cover according to an embodiment of the present invention.

FIG. 7 is a bottom view of the sump cover.

Referring to FIG. 7, the thermal-bonding rib 226 that are thermally-bonded to the flow guide 21 is provided at a bottom of the sump cover 22. That is, the shape of the thermal-bonding rib 226 corresponds to that of the flow guide 21 so that the inner space of the flow guide 21 can be completely enclosed and sealed. The lower nozzle extension 216 formed on the flow guide 21, the water guide extension 215, and the sampling passage 212 are completely sealed. Therefore, the washing water existing in each space does not leak. The backflow hole 225 is formed on an upper portion of the soil chamber 211 so that the washing water supplied through the soil chamber 211 flows back through the backflow hole 225 and there is no leak through the lower nozzle extension 216 and the water guide extension 215.

An end of the lower nozzle extension 216 communicates with the nozzle connecting portion 224. An end of the water guide extension 215 communicates with the water guide connecting portion 223.

At least a portion of the nozzle connecting portion 224 formed on a center of the sump cover 22 forms a surface contouring an inner circumferential surface of the end of the lower nozzle extension 216 formed on the flow guide 21. That is, a portion of the lower nozzle connecting portion 224 is formed to correspond to the curvature of the end of the lower nozzle extension 216. Therefore, the inner circumference of the end of the lower nozzle extension 216 and the part of the inner circumference of the lower nozzle connecting portion 224 forms a smooth surface.

As the lower nozzle connecting portion 224 is formed to closely contact the end of the lower nozzle extension 216, the pressure drop of the washing water pumped to the lower nozzle extension 216 could be prevented.

If the lower nozzle connecting portion 224 is spaced apart from the lower nozzle extension 216, some of the washing water pumped to the lower nozzle extension 216 may not be directed to the lower nozzle.

The washing water pumped toward the lower nozzle extension 216 forms a rotating flow as it flows through a space formed between the outer circumference of the lower nozzle connecting portion 224 and the inner circumference of the lower nozzle extension 216. This rotating flow (washing water) flows back to the vario valve, and thus collides with the washing water that is being supplied to the lower nozzle extension 216, thereby forming a turbulent flow. As a result, fluid flow resistance is generated near the lower nozzle connecting portion 224, and thus the pressure of the washing water is reduced due to the fluid flow resistance.

To overcome the above problem, the lower nozzle connecting portion 224 is tightly sealed and connected to the end of the lower nozzle extension 216.

Figure 8:
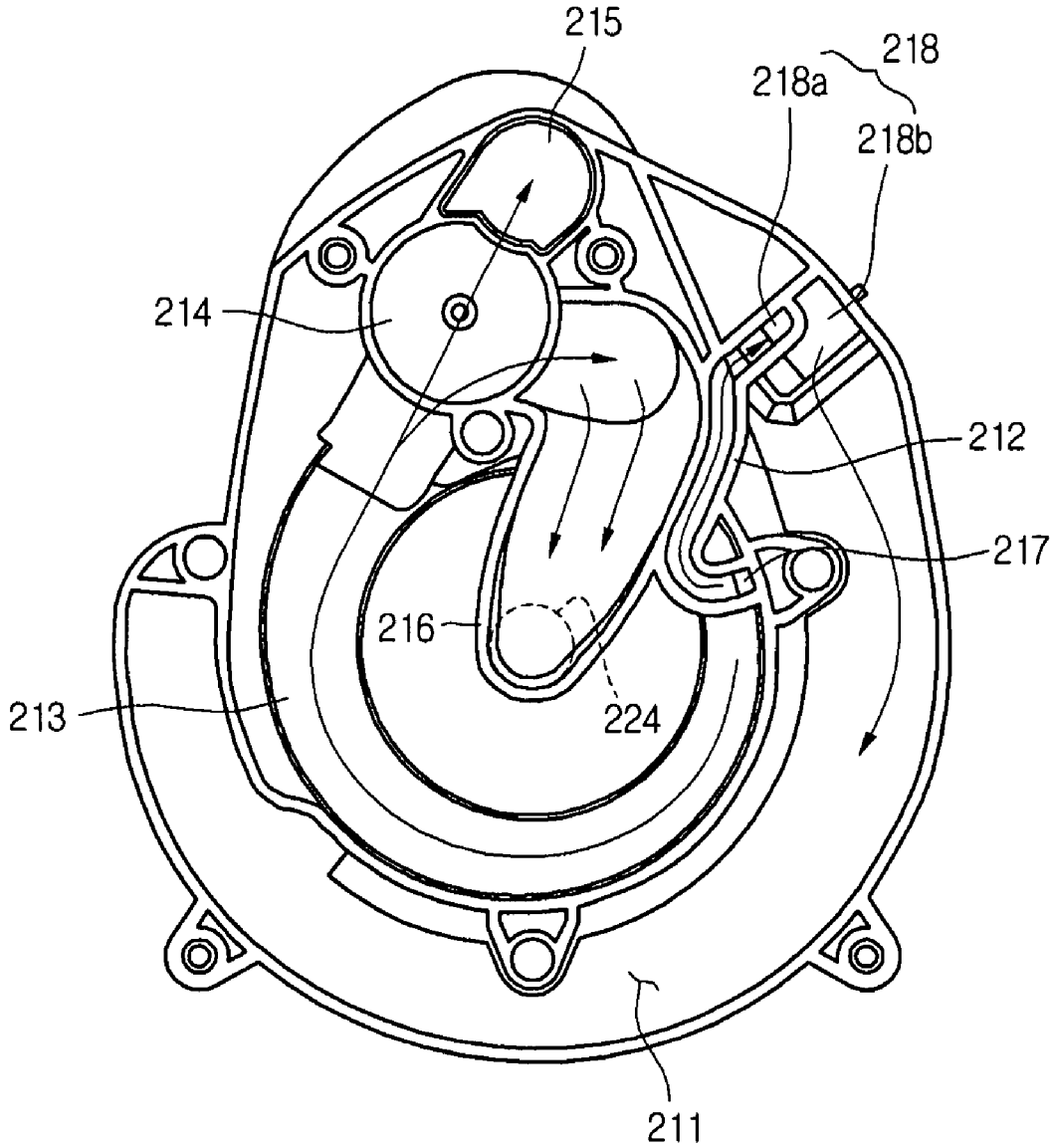
FIG. 8 is a top plane view of a flow guide according to an embodiment of the present invention.
Figure 9:
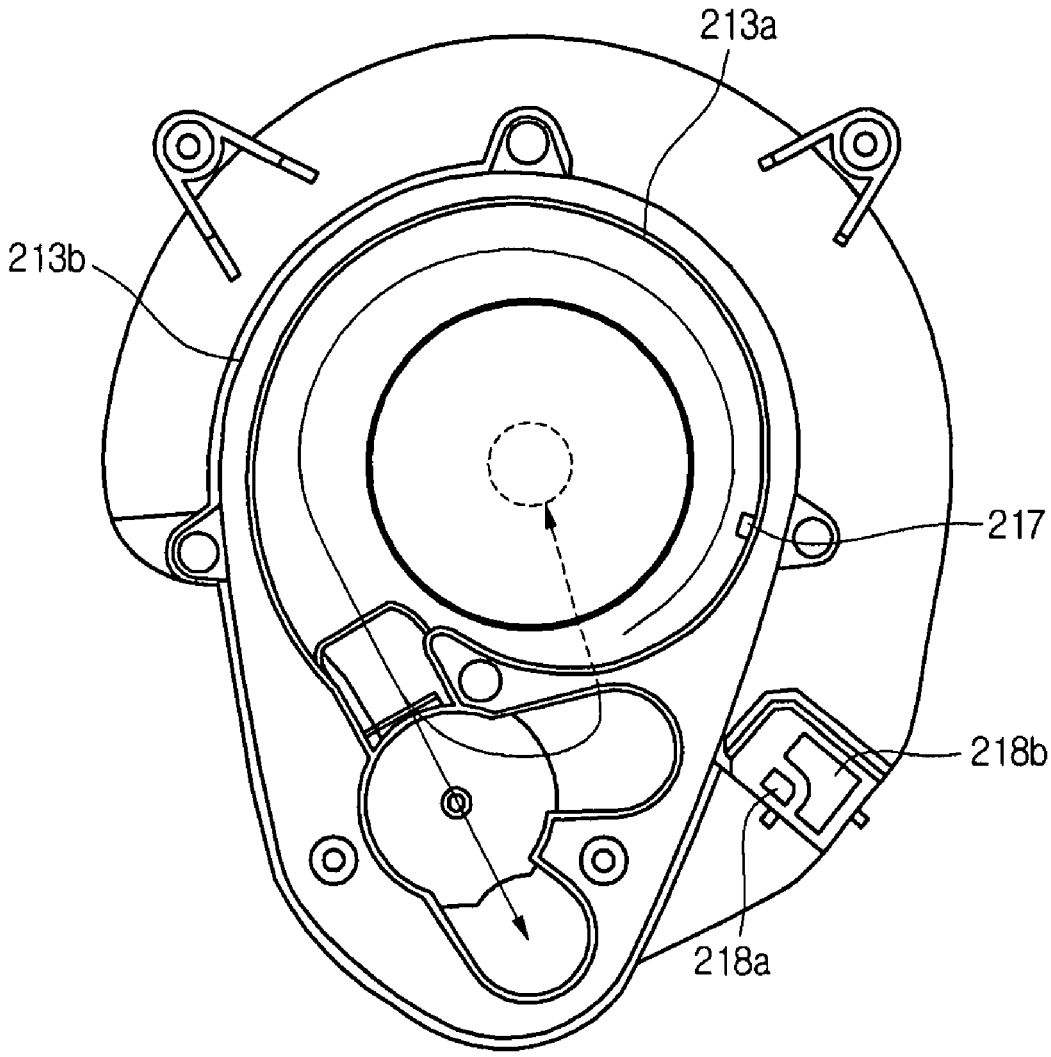
FIG. 9 is a bottom view of the flow guide of FIG. 8.

FIG. 8 is a top plane view of the flow guide and FIG. 9 is a bottom view of the flow guide.

Referring to FIGS. 8 and 9, the soil chamber 211 is formed along an edge of the flow guide 21. A pump case cover 213 is formed in the soil chamber 211. A volute rib 213*a* is formed on a bottom of the pump case cover 213 to cover the inner circumferential edge of the pump case 121 formed on the pump housing 12. The volute rib 213*a* is provided with a sealer pressure rib 213*b* corresponding to the shape of the pump housing 12.

The sealer pressure rib 213*b* is designed to press in a side direction the sealer (10 of FIG. 10) disposed around the outer circumference of the pump housing 12. The sealing member disposed around the pump housing is generally designed to be pressed downward by a member seating on the pump housing.

In a case where the sealing member is designed to be pressed downward, if the pressing force is small, the sealing cannot be perfectly realized and thus the washing water may leak.

To solve the above problem, the sealer 30 may be designed to be pressed in a horizontal direction rather than the vertical direction to prevent the leak of the washing water.

An operation for supplying the washing water pumped by the washing pump to the nozzles is realized on the bottom of the flow guide 21.

That is, the washing water is pumped by the washing pump while rotating in a volute shape. The vario valve is located on a discharge portion of the washing pump to selectively direct the washing water to the lower nozzle or the water guide.

The flow guide 21 is provided with a vario valve cover 214 for supporting a top surface of the vario valve. The water guide extension 215 and the lower nozzle extension 216 extend from the vario valve 214. The water guide extension 215 is formed to be almost parallel with the washing water flow direction discharged from the washing pump. This is to minimize the flow loss as the washing water passes through the vario valve.

The lower nozzle extension 216 is curved in a direction corresponding to the rotation direction of the washing water rotating in the washing pump.

As shown in FIG. 8, the washing water flows or rotates a direction indicated by the arrows and is discharged from the washing pump toward the vario valve. The washing water directed to the water guide flows straight from the discharge hole of the washing pump. Furthermore, the washing water directed to the lower nozzle flows along the lower nozzle extension 216 curves in a direction identical to the rotational direction of the washing water in the washing pump. Accordingly, even when the flow direction of the washing water is switched by the vario valve, the flow loss can be reduced by the above-described passage structure.

The inner circumference of the lower nozzle extension 224 formed on a central portion of the sump cover 22 is coplanar to the inner circumference of the end of the nozzle extension 216. This will be described in more detail later.

Meanwhile, the sampling hole 217 is formed on the edge of the pump case cover 213 forming the flow guide 21. That is, the pump case cover 213 covers the pump case 121 formed inside the pump housing 12. Therefore, a part of the washing water flowing or rotating in the pump case 121 ascends through the sampling hole 217 and flows along the sampling passage 212.

An end of the sampling passage 212 communicates with a drain pump connection tube 218.

That is, the drain pump connection tube 218 extends from the flow guide 21 downward by a predetermined length and is connected to the drain pump case. A membrane is formed in the drain pump connection tube 218 to divide it as a drain hole 218*a* and a backflow hole 218*b*. An end of the sampling passage 212 is connected to the drain hole 218*a* and an end of the soil chamber 211 is connected to the backflow hole 218*b*.

With the above-described structure, the washing water branched off along the sampling passage 212 falls to the drain pump through the drain hole 218*a*. In a state where the drain pump is not driven, the washing water falling to the drain pump flows back through the backflow hole 218*b* and flows to soil chamber 211.

A backflow side end of the soil chamber 211 is lower than an opposite end of the soil chamber and thus the food wastes and washing water accumulated in the soil chamber 211 are drained together during the draining process.

Figure 10:
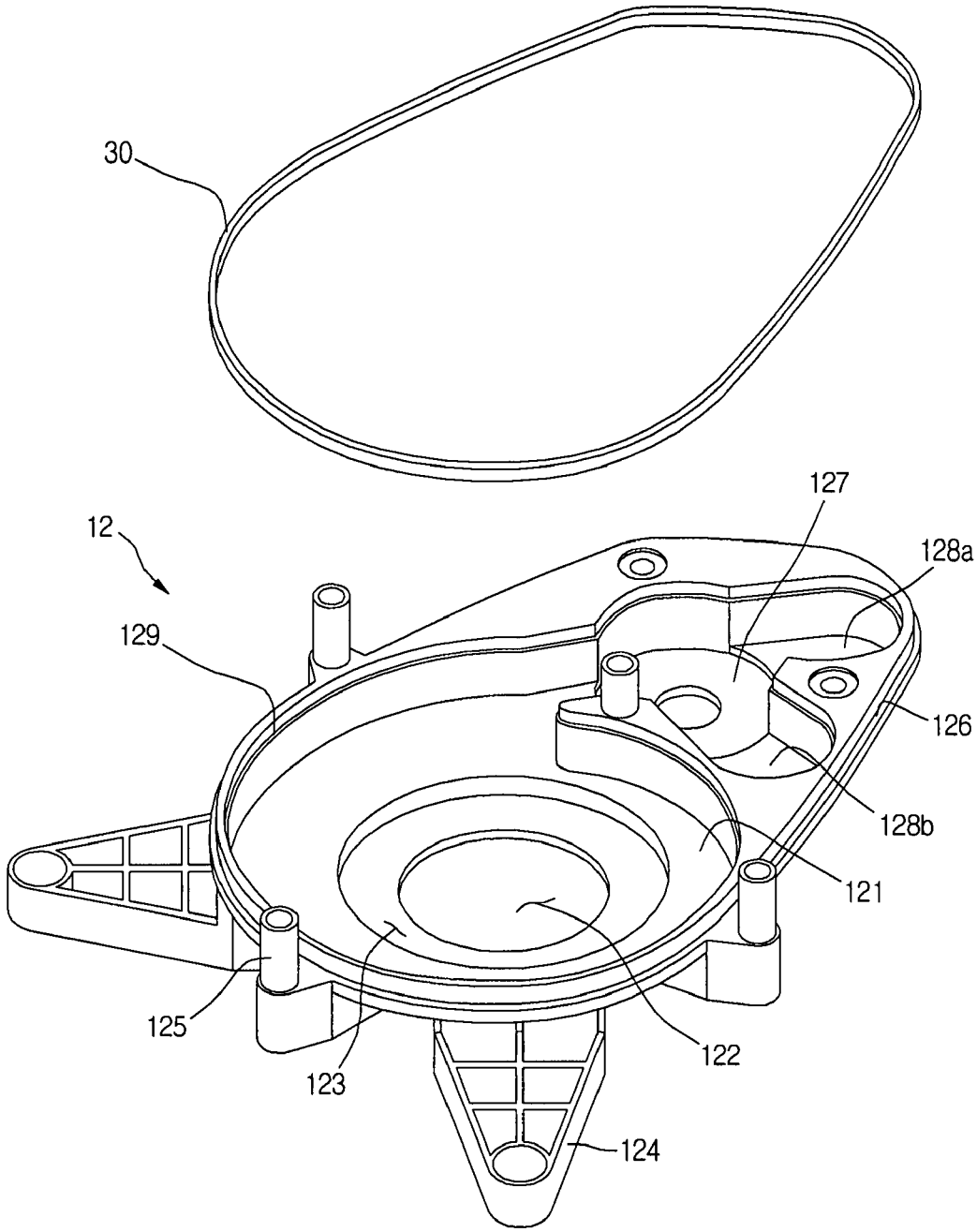
FIG. 10 is a perspective view of a pump housing according to an embodiment of the present invention.

FIG. 10 is a perspective view of the pump housing.

Referring to FIG. 10, the pump housing 12 is disposed inside the sump case 11 and coupled thereto by a fastener such as a screw.

That is, the pump housing 12 is provided with a plurality of fixing legs 124 that will be fixed on the sump case 11. The fixing leg 124 is provided on an outer circumferential portion of the pump housing. The fixing leg 124 is provided at an end with a hole in which a fixing boss will be inserted. The pump housing 12 is provided at an outer circumference with a flow guide fixing boss 125 that is inserted into the flow guide 21. The pump housing 12 is securely fixed on the bottom of the flow guide 21 by the coupling member inserted into the flow guide fixing boss 125. The pump cases 121 is formed with a volute shape in the pump housing 12. The screen filter (17 of FIG. 3) is coupled to a lower end of the suction hole 122 so that the washing water is introduced into the pump case 121 after the foreign objects of the washing water is primarily filtered.

The pump case 121 is provided at a discharge side with a vario valve seating portion 127 on which the vario valve (19 of FIG. 3) seats. A water guide extension passage 128*a* and a lower nozzle guide extension passage 128*b* extend from the vario valve seating portion 127. Here, the water guide extension passage 128*a* extends straight from a discharge hole of the pump case 121. The lower nozzle guide passage 128*b* is curved in a direction corresponding to the rotational direction of the washing water in the pump case 121.

A sealing seating portion, where the sealer 30 sits, is formed on the outer circumference of the pump housing 12. A volute rib seating portion 129 is formed on upper edges of the pump case 121, vario valve seating portion 127, and water guide extension passage 128*a*, lower nozzle extension passage 128*b* with predetermined steps to form a closed-circle.

A bottom surface of the pump case 121 is formed at an identical level with a bottom surface of the discharge portion of the pump case 121 to uniformly maintain the washing water pressure. In the related art, since the bottom surface of the discharge portion of the pump case 121 is inclined with a predetermined height, the washing water pressure is reduced.

In addition, since the vario valve 19 is provided in the pump housing 12 having the pump case 121, only the through hole through which the valve shaft of the vario valve penetrates is formed on the bottom surface of the vario valve seating portion 127 and the discharge portion of the pump case 121, the water guide extension passage 128*a* and the lower nozzle extension passage 128*b* are integrally formed with the vario valve seating portion 127. As a result, the washing water discharged from the pump case 121 does not leak through the outer circumference of the vario valve 19 during the direction of the washing water to the water guide extension passage 128*a* or the lower nozzle extension passage 128*b*.

Figure 11:
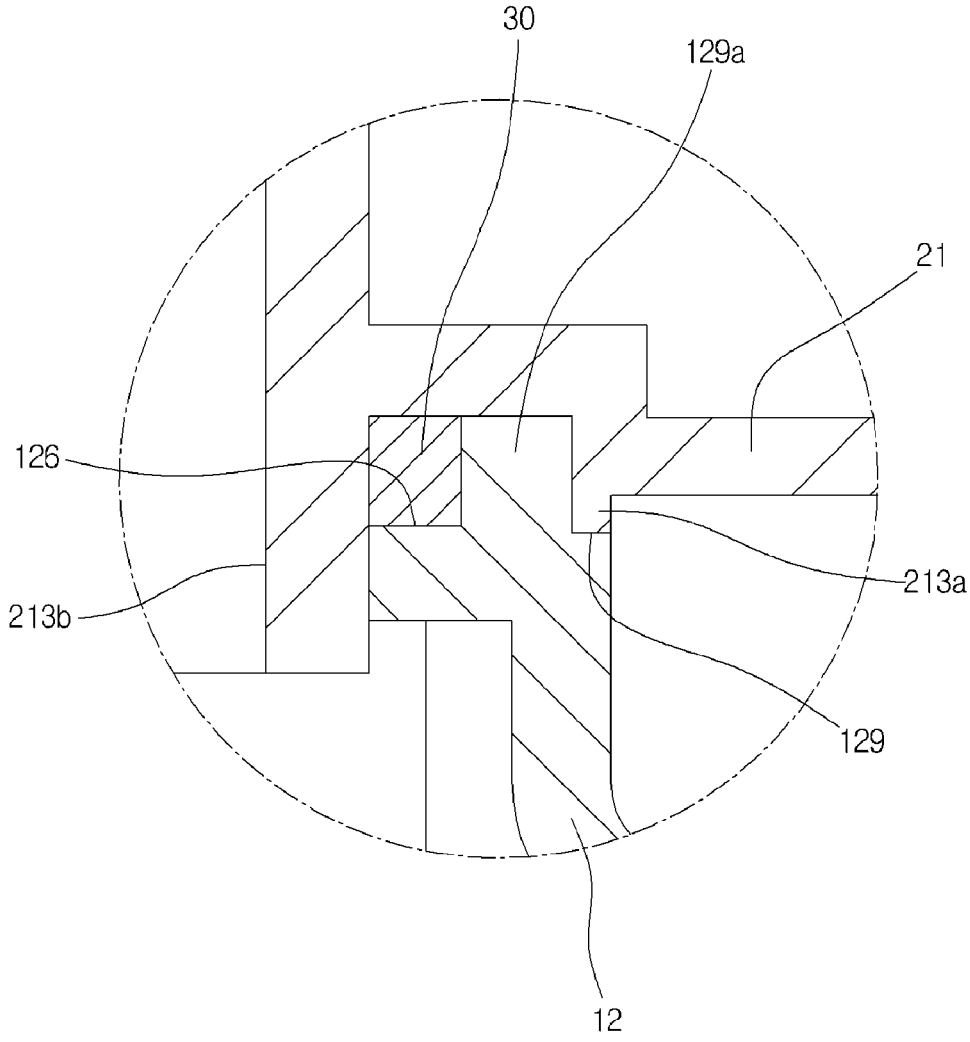
FIG. 11 is an enlarged view of a portion A of FIG. 4.

FIG. 11 is an enlarged view of a portion A of FIG. 4. As illustrated, the pump housing 12 includes a supporter 129*a* that supports the flow guide 21, a stepped portion on which the sealing member is disposed, and a volute rib seating portion 129 that is stepped in response to a shape of the pump case. The stepped portion is provided at an outer side of the supporter 129*a* and the volute rib seating portion 129 is provided at an inner side of the supporter 129*a*.

Referring to FIG. 11, the sealer seating portion 126 is formed on the outer circumference of the pump housing 12 with a step; more specifically it is provided at an outer side of the supporter 129*a*. The sealer pressing rib 213*b* extending from the bottom of the flow guide 21 closely contacts the outer circumference of the pump housing 12. The sealer 30 occupies the space defined between the sealer pressing rib 213*b* and the sealer seating portion 126.

The volute rib seating portion 129 is formed on an inner circumferential edge of the pump case with a step, more specifically is it is provided at an inner side of the supporter 129*a*. The volute rib 213*a* extending from the bottom of the flow guide 21 sits on the volute rib seating portion 129. Here, a separate sealing member may be interposed between the volute rib 21*a* and the volute rib seating portion 12. The volute rib 213*a* presses an inner side surface or a top surface of the sealing member seating on the volute rib seating portion 129 to prevent the washing water from leaking.

As described above, since the sealer 30 is disposed around the outer circumferential edge of the pump housing 12 and the pressed in the side direction by the sealer pressing rib 213*b*, the leak of the washing water rotating in the pump case 121 can be prevented.

Washing water is prevented from leaking in the pump case 121 primarily by the volute rib 213*a*, secondarily by the sealer 30, and thirdly by the sealer pressing rib 213*b*.

If the sealer 30 is seated on the top surface of the pump housing 12, the washing water has a great likelihood of leaking through a gap between the sealer 30 and the pump housing 12 or between the sealer 30 and the flow guide 21.

Figure 12:
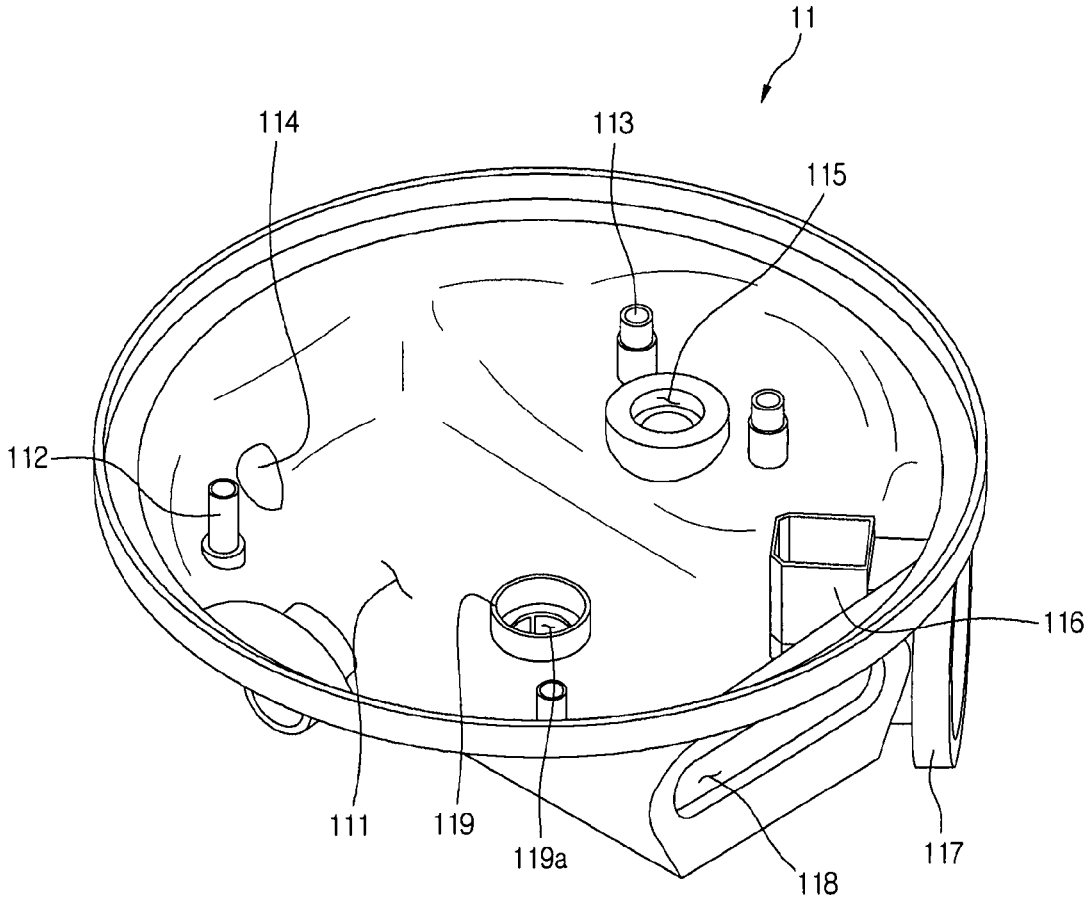
FIG. 12 is a perspective view of a sump case according to an embodiment of the present invention.

FIG. 12 is a perspective view of the sump case.

Referring to FIG. 12, a water holding portion 111 is formed in the sump case 11.

The sump case 11 is provided with first and second fixing bosses 112 and 113 for fixing the pump housing 12. The first fixing boss 112 penetrates the fixing leg 124 of the pump housing 12 and the second fixing boss 113 is coupled to the bottom surface of the pump housing 12 opposite to the fixing leg 124.

Furthermore, the sump case 11 is provided at a bottom surface with a motor shaft penetration hole 119*a* through which a motor shaft of the washing motor penetrates. A cylindrical motor sealer seating portion 119 extends around the motor shaft penetration hole 119*a*. A circular sealing member is inserted in the motor sealer seating portion 119 to prevent the washing water from leaking through the motor shaft.

Furthermore, a water supply hole 114 is formed on a side of the sump case 11 and a drain pump case 117 is provided on another side of the sump case 11. That is, a drain impeller is received in the drain pump case 117 and the drain pump impeller is connected to the drain motor 15 (see FIG. 4).

A heater insertion hole 118 is formed on another side of the sump case 11. A vario valve shaft penetration hole 115 is formed on a side of the bottom surface of the sump case 11. Therefore, the shaft of the vario valve 19 penetrates the sump case 11 and is connected to the vario motor attached on the bottom surface of the case 11.

In addition, a drain guide 116 is provided inside the sump case 11 to correspond to the positioning of the drain pump case 117.

A drain pump connection tube (218 of FIG. 8) extending from the bottom of the flow guide 21 is fitted in the drain guide 116. Therefore, the washing water falling through the drain hole 218*a* of the drain pump connection tube 218 is directed to the drain pump case by the drain guide 116. When the drain pump is not driven, the washing water collected in the drain pump case 117 flows back along the drain guide 116 and is then directed to the soil chamber 211 through the backflow hole 218*b* of the drain pump connection tube 218. A drain hole (not shown) is formed on a lower end of the drain guide 116 and communicates with the water holding portion 111 of the sump case 11. A check valve is installed in the drain hole to prevent the washing water collected in the drain pump case 117 from flowing back to the water holding portion 111.

When the drainage starts, the washing water and the food wastes stored in the soil chamber 211 and the water holding portion 111 are simultaneously directed to the drain pump case 117 through the drain guide 116 and then discharged to the external side by the operation of the drain impeller.

It will be apparent to those skilled in the art that various modifications and variations can be made in the present invention. Thus, it is intended that various modifications and variations of this invention are covered if they come within the scope of the appended claims and their equivalents.

What is claimed is:

1. A sump for a dishwasher, comprising:

a sump case for collecting washing fluid;

a pump housing seated on the sump case, the pump housing being provided with a pump case therein;

a filtering assembly positioned on a upper portion of the pump housing to collect foreign objects and having a flow guide for collecting objects; and a sealing member disposed around the pump housing, wherein the flow guide includes a pressing rib for pressing a side surface of the sealing member and a volute rib spaced apart from the pressing rib, the pressing rib and the volute rib are protruded downward from the flow guide, and wherein the pump housing includes a supporter that supports the flow guide, a stepped portion on which the sealing member is disposed, and a volute rib seating portion that is stepped in response to a shape of the pump case, the stepped portion is provided at an outer side of the supporter and the volute rib seating portion is provided at an inner side of the supporter.

2. The sump according to claim 1, wherein the filtering assembly further comprises:

a sump cover covering the flow guide; and a self-cleaning filter disposed on the sump cover to filter out the foreign objects.

3. The sump according to claim 1, wherein a sealing member is interposed between the volute rib seating portion and the volute rib.

4. A sump for a dishwasher, comprising:

a sump case for collecting washing fluid;

a pump housing seated on the sump case, the pump housing being provided with a pump case therein;

a filtering assembly positioned on a upper portion of the pump housing to collect foreign objects and having a flow guide for collecting objects; and a sealing member disposed around the pump housing, wherein the flow guide includes a pressing rib for pressing a side surface of the sealing member and a volute rib spaced apart from the pressing rib, the pressing rib and the volute rib is protruded downward from the flow guide, wherein the pump housing includes a supporter that supports the flow guide, the sealing member surrounds an outer side surface of the supporter and the volute rib surrounds at least a portion of inner side surface of the supporter, wherein the sealing member and the volute rib are seated on the pump housing.

* * * * *